United States Patent [19]

Weaver

[11] 4,084,498

[45] Apr. 18, 1978

[54] TRUSS MAKING APPARATUS

[75] Inventor: Austin S. Weaver, Zeeland, Mich.

[73] Assignee: Ottawa Roof Truss, Inc., Zeeland, Mich.

[21] Appl. No.: 702,055

[22] Filed: Jul. 2, 1976

[51] Int. Cl.[2] ..... B30B 3/02

[52] U.S. Cl. ..... 100/210; 100/DIG. 13; 100/173; 269/321 F; 227/152

[58] Field of Search ..... 100/DIG. 13, 100, 210, 100/218, 173; 144/288 C; 269/321 F; 29/200; 227/152

[56] References Cited

U.S. PATENT DOCUMENTS

| | | | |
|---|---|---|---|
| 2,983,292 | 5/1961 | McKinley | 100/DIG. 13 |
| 3,100,301 | 8/1963 | Black | 100/DIG. 13 |
| 3,241,585 | 3/1966 | Jureit | 100/DIG. 13 |
| 3,255,943 | 6/1966 | Sanford | 100/DIG. 13 |
| 3,375,778 | 4/1968 | Newman | 100/DIG. 13 |
| 3,379,354 | 4/1968 | Moehlenpah | 100/DIG. 13 |
| 3,538,843 | 11/1970 | Lubin | 100/DIG. 13 |
| 3,749,391 | 7/1973 | Templin | 100/DIG. 13 |

*Primary Examiner*—Billy J. Wilhite
*Attorney, Agent, or Firm*—McGarry & Waters

[57] ABSTRACT

A floor truss making apparatus having a pair of slightly curved rails, each with a plurality of positioning pads for retaining elongated truss plates forming the top and bottom of the truss, end truss plates for the end of the truss, and angle truss plates which are disposed at an acute angle between the elongated top and bottom truss plates. A pad is provided at each of the truss joints. The pads are adjustably fixed to the rails and the rails are adjustable with respect to each other so that a wide size range of trusses can be constructed with the apparatus. Adjustable nail plate positioning means are provided on each pad to properly locate and hold the nail plates under the truss. The nail plates are also placed on top of the assembled trusses. A gantry roller press rolls over the top of the truss (or other pressure means are provided) to at least partially force both nail plates into the truss plates. The truss is transferred to a second pressing operation to complete the seating of the nail plates into the truss. The truss has a slightly curved shape or camber for prestressing of the floor truss.

14 Claims, 7 Drawing Figures

TRUSS MAKING APPARATUS

BACKGROUND OF THE INVENTION

1. Field of the Invention

This invention relates to a truss making apparatus. In one of its aspects, the invention relates to an apparatus for making floor trusses from wooden members wherein the apparatus is adjustable to make trusses of different lengths, widths and bracing patters.

2. State of the Prior Art

Wooden trusses for both roofs and floors have been used for making trusses of dimensional lumber and nail or connector plates. The connector or nail plates are made of 14–20 gauge metal sheets from which are punched a multiplicity of closely spaced jagged projections. These projections extend outwardly from a face of the nail plates and are driven into the lumber at the joints to join the lumber together.

Normally, the trusses are assembled on a table, the nail plates are placed over the top of the wooden truss members and driven into the joints. For this purpose, special jigging is available. A gantry roller press is provided to pass over the truss and press the nail plates into place. After one side of the truss is completed, the truss is turned over, the nail plates are placed at the joints of the second side and a roller press is again rolled over the truss to drive the second set of nail plates into the truss members at the joints.

A truss making apparatus for making roof trusses is disclosed in U.S. Pat. No. 3,255,943 issued to Arthur C. Sanford on June 14, 1966. The Sanford apparatus comprises supporting pads which are mounted on rails for adjustable movement along the rails for making different height trusses. The rails themselves are supported on other rails and are mounted for movement toward and away from each other so that different shapes and sizes of trusses can be made.

Black, in U.S. Pat. No. 3,100,301, issued Aug. 13, 1963, and in U.S. Pat. No. 2,996,721, issued Aug. 22, 1961, discloses a truss making apparatus similar to the Sanford apparatus except that the nail plates are pressed into the joints by a hydraulic cylinder from beneath and a pressure plate is positioned over the joint to react to the pressure from the cylinder to press the nail plates on top of the truss into the lumber truss members. In the later Black patent, the trusses are prestressed by urging upper chords toward the lower chords during the joining operation. The resulting truss is somewhat compressed between the top and bottom chords.

Another truss making apparatus is disclosed in the U.S. Pat. No. 3,241,585 to Jureit, issued Mar. 22, 1966. In the Jureit apparatus, the jigs are supported on rails, one of which is adjustable toward and away from the other. The Jureit apparatus as well as the other aforementioned apparatus is generally designed for making roof trusses and is generally not appropriate for making floor trusses.

SUMMARY OF THE INVENTION

According to the invention, there is provided an apparatus for making floor or roof trusses which have parallel first and second elongated truss plates, end truss plates at the ends of the first and second truss plates and angle plates disposed and braced between the first and second truss plates. The apparatus includes a supporting base, first and second rails mounted on the base and means for evenly adjusting the spacing between the first and second rails to adjust for the different truss heights. A plurality of first positioning pads are adjustably secured to the first rail in spaced relationship to each other, at least end ones of the first positioning pads have stop means to retain end truss plates thereon perpendicular to the first and second rails. The end and the other of the first positioning pads also have a means for retaining the first elongated truss plate parallel to the first rail and means for retaining nail plates on each of the positioning pads in a given predetermined location.

A plurality of second positioning pads are adjustably mounted on the second rail in spaced relationship to each other. At least the end ones of the positioning pads have stop means to retain an end truss plate thereon perpendicular to the first and second rails, the end ones and the other of the second positioning pads having means for retaining second elongated truss plates parallel to the second rail. Means are provided for retaining a nail plate on each of the second positioning pads at a given predetermined location. Further, means are provided for applying pressure to the second elongated truss plate to firmly seat all of the truss plates together for the joining operation.

The first and second positioning pads are so spaced and aligned so as to support the opposite ends of all of the angle truss members extending between the first and second truss members. Means are provided for at least partially pressing the nail plates simultaneously into the top and the bottom of the trusses at the joints of the truss members.

The first and second rails have a slight congruent curvature so that the resulting truss has a slight camber or curvature. This camber or curvature is automatically built into the trusses regardless of the size and results in a prestressing of the trusses in a manner so as to strengthen the trusses under load. Desirably, the curvature results in a deviation of about 0.21% from linearity but can range from 0.10–0.40% in deviation. In terms of a 40-foot truss, for example, the preferred deviation would be about 1 inch. Because the camber is built into the rails, each truss will have the same radius of curvature regardless of size.

At least one of the first and second positioning pads has means for aligning the truss angle plate ends at a given position from the pads to assure uniformity and accuracy of the resulting trusses. These alignment means can be in the nature of scribed lines on the positioning pad.

Desirably, the second positioning pads further comprise stop means for retaining the second truss members in a given position against the force of the pressure applying means so that the size of the truss is accurately ascertained.

The pressure applying means on the second positioning pads comprise a plate pivotably actuated between a first position in nonengaging relationship with the second truss member and a second position in bracing relationship with respect to the second truss plate. Means are provided for actuating pivotable movement of the plate between the first and second positions. Further, lock means are provided on the second pads for locking the plate rigidly in the second position. In the event that the nail plates are not completely seated by the first pressing operation, means are provided for transferring the assembled trusses to a second conveyor by which the truss is conveyed through a means for completely seating the nail plates in the truss.

BRIEF DESCRIPTION OF THE DRAWINGS

The invention will now be described with reference to the accompanying drawings in which.

DESCRIPTION OF THE PREFERRED EMBODIMENT

Figure 1:
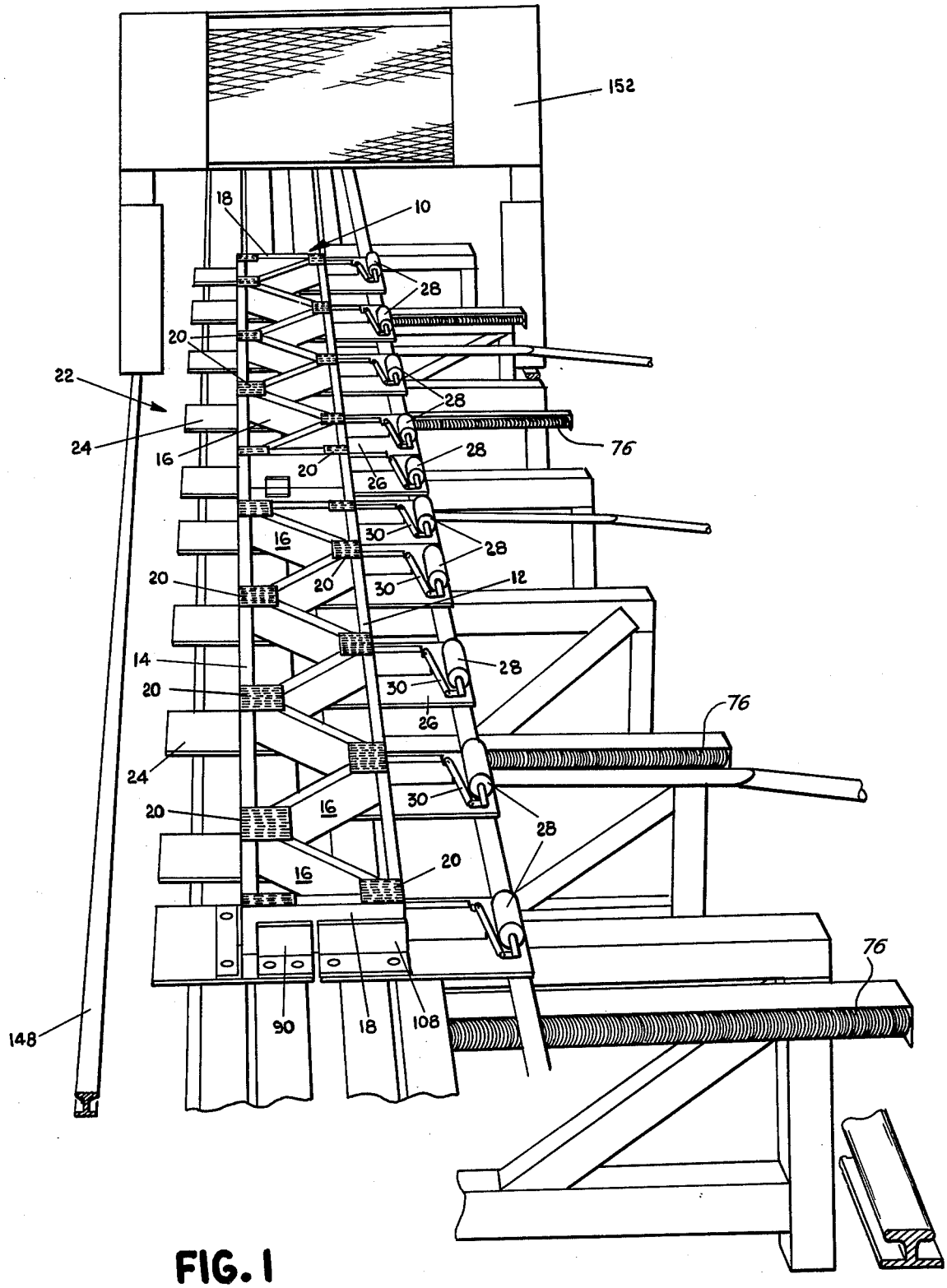
FIG. 1 is a perspective view of a truss on a truss making machine according to the invention.

Referring now to the drawings, and to FIG. 1 in particular, there is illustrated a truss 10 formed from a top plate 12, a bottom plate 14 and a plurality of angle plates 16 positioned between the top and bottom plates 12 and 14. End plates 18 are positioned at each end of the truss between the top and bottom plates 12 and 14 respectively. Nail plates 20 are positioned at the joints between the angle plates 16 and the top, bottom and end plates 12, 14 and 18 to secure the plates together. In the art, the top and bottom plates 12 and 14 are sometimes referred to as top and bottom chords and the angle plates are referred to as web markers.

A truss making machine 22 supports the truss 10 and comprises a plurality of bottom pads 24 and a plurality of top pads 26. Each of the bottom and top pads is positioned at each joint between the angle or end plates and the top and bottom plates. Pressure cylinders 28 having linkages 30 are provided on the top pads 26 for securely bracing the truss between the bottom of top pads 24 and 26 during the initial joining operation.

Figure 2:
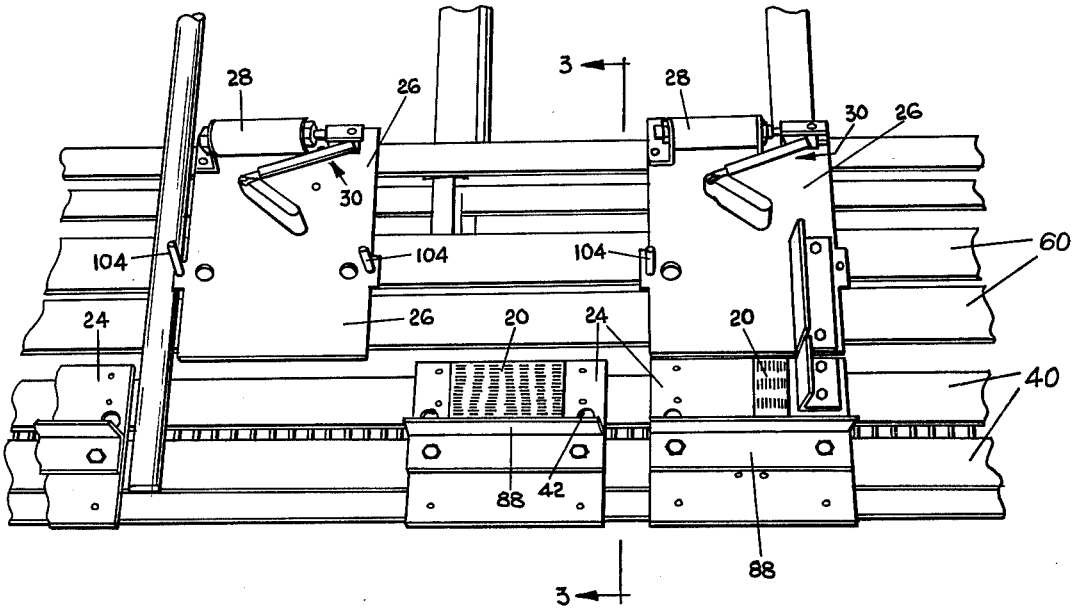
FIG. 2 is a top view of a section of the truss making machine without the truss members thereon.
Figure 3:
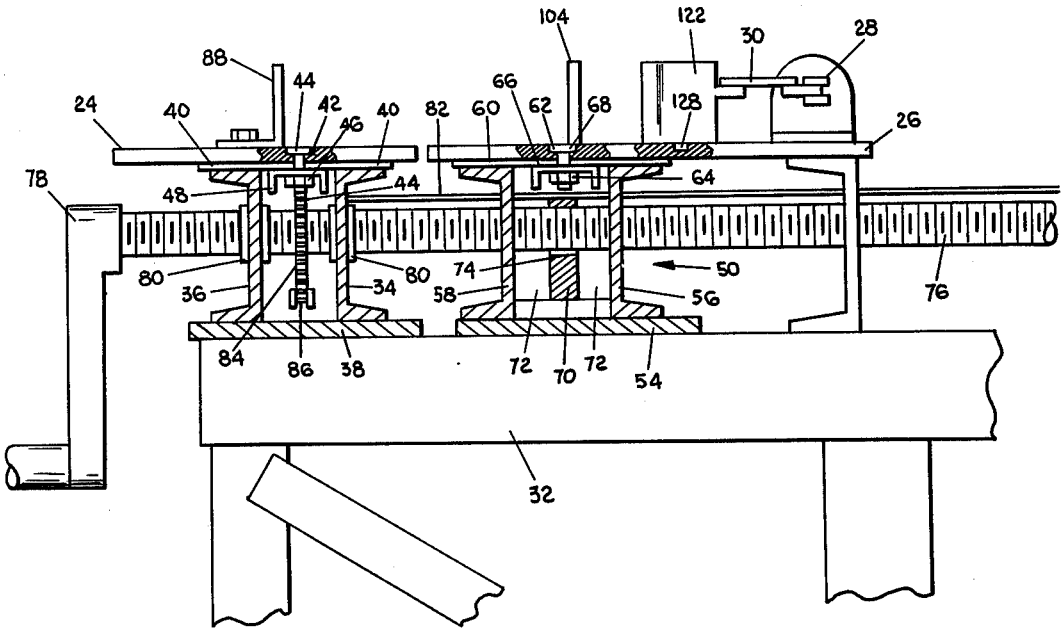
FIG. 3 is a side view in section of the truss making machine taken along lines 3—3 of FIG. 2.

Referring now to FIGS. 2 and 3, a base support 32 having various vertical and horizontal members joined together provides support for the top and bottom pad assemblies. The bottom pad assembly comprises a pair of elongated channel members 34 and 36 joined at the bottom portion through a base plate 38. A pair of rail members 40 are secured to the top of the channel members 34 and 36, leaving a narrow slot therebetween. The channel members 34 and 36 are welded in place on the base support 32. The opening between the channel members 34 and 36 is slightly curved between the ends of the rails so that a slight curvature can be built into the resulting truss.

The bottom pad 24 has a pair of recessed holes 42 extending therethrough and in registry with the narrow slot between the rail members 40. A bolt 44 having a nut 46 extends through recessed hole 42 and through a clamp plate 48 to releasably secure the bottom pad 24 in a given adjusted position along the rail slot formed by the rail members 40.

A movable support 50 for the top pads 26 is similar in construction and comprises a base plate 54 secured to a pair of channel members 56 and 58. However, the base plate 54 is not secured to the base support 32 so that the movable support 50 is slidable along the top of the base support 32. A pair of rail plates 60 are secured to the top of the channel members 56 and 58 and form a narrow slot therebetween. Bolts 62 are positioned through recessed holes 68 in the top pads 26 and extend through a clamp plate 66 to secure the top pads 26 in various adjusted positions along the rail plates 60. To this end, a nut 64 threadably engages the bolt 62 at the bottom portion thereof so that the bolt clamps the rail plates 60 between the top pad 26 and the clamp plate 66.

The opening between the channel members 56 and 58 has a curvature congruent with that of the channel members 34 and 36 so that the top plate member 12 will have the same curvature as the bottom plate 14. The degree of curvature of these rails can vary but is generally selected so as to give a slight upward curvature to the resulting truss without resulting in a loss of substantial squareness at the ends of the truss.

A block 70 having a threaded hole 74 therethrough is secured to the channel members 56 and 58 through supports 72. A threaded rod 76 threadably engages the threaded hole 74 of block 70 and is journaled in journal plates 80 which are mounted on the channel members 34 and 36. A handle 78 is provided on one end of the threaded rod 76 for ease of rotating the rod as desired. A shield 82 is secured to channel member 34 above the threaded rod 76 and extends laterally above the rod 76 for protective purposes. To this end, the shield 82 extends through the channel members 56 and 58 and through the block 70.

A plurality of threaded rods 76 are provided along the length of the machine so that the movable support 50 can be uniformly moved toward or away from the fixed support which mounts the bottom pads 24. In order to synchronize the rotation of all threaded rods together, each threaded rod has mounted thereto a sprocket 84. A chain 86 is trained around the sprockets 84 so that the sprockets 84 and the threaded rods 76 are all driven in unison as the handle 78 is turned. Alternatively two or more cranks and chain assemblies can be provided to separate segments of the apparatus 22 for adjusting the spacing between the top and bottom pads in separate operations.

The threaded rods 76 connect the two sets of rails together near to the positioning pads. By this construction, the positioning pads are braced with respect to each other so that the appropriate lateral pressure can be applied to the trusses during joining while maintaining dimensional tolerances in a manner which will be described hereinafter.

Figure 4:
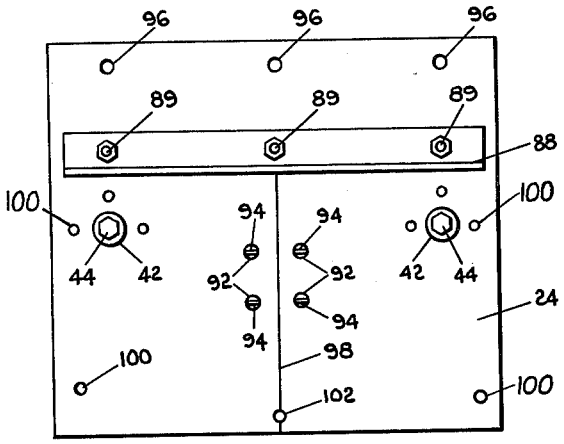
FIG. 4 is an enlarged view of a portion of the truss machine.

Referring now to FIGS. 3 and 4, the bottom pads 24 have a stop plate 88 secured at a bottom edge thereof through a plurality of bolts 89. Tapped holes 96 are also provided for movement of the stop plate 88 to the very back edge of the bottom pad 24. A plurality of threaded central holes 92 are also provided forwardly of the plate 88. Each of the holes 92 contains a nail plate positioning lug 94 which projects slightly above the surface of the pad 24. The positioning lugs 94 are sized so as to fit in the openings in the nail plates 20 which are positioned on the pads 24. Thus, various sizes of nail plates can be positioned on the pads 24 due to the fact that the pads are engaged on the bottoms by the lugs 94. The lugs 94 have a threaded outer surface and an upper narrow blade end which projects into openings in the nail plate. The threaded body of the positioning lugs 94 makes them vertically adjustable with respect to the surface of the pads for precise vertical positioning.

A scribe center line 98 is provided in a central location of the pad 24 perpendicular to the stop plate 88.

The scribe center line gives a visual reference for positioning the angle plate 16 in a correct location on the pads 24. A pair of tapped holes 100 are provided at the side edge of the bottom pad 24 and can be used to position an end retainer plate 90 (see FIG. 1) or stop pins in the pad which is used at the end of the truss. Each of the bottom pads has tapped holes at one side thereof so that it can be used as an end pad if desired. By this structure, the apparatus can be quickly and easily modified to accommodate shorter or longer trusses. The end pads can be easily converted to a pad which retains an end plate.

A tapped hole 102 is also provided on the center line 98. A threaded pin can be positioned within the tapped hole 102 for alignment purposes when setting up the pads for a new truss size. To this end, a spacer bar (not shown) having holes at each end is provided for spacing the pads. The holes in the spacer bar fit over the pins in the end pad and an adjacent pad. The pads are then tightened in place. The spacer bar is removed and the process is repeated using a properly aligned pad and an adjacent pad which is unaligned until all pads are spaced a desired distance apart.

Figure 5:
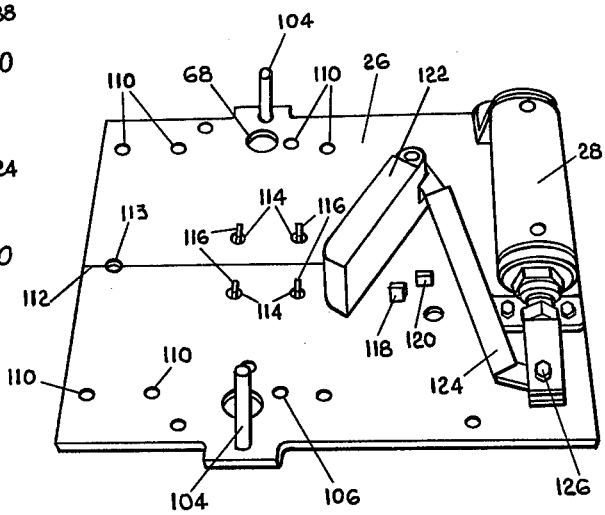
FIG. 5 is an enlarged view of another portion of the machine.

Reference is now made to FIGS. 3 and 5 for a description of the top pads 26. These pads are quite similar to the bottom pads 24 except for a pressure-applying mechanism in lieu of the stop plates 88. Stop pins 104 are provided at the sides of the pads 26. A plurality of tapped holes 110 are provided at the bottom and sides of the pad 26 for positioning other stop pins so that the pad can be used as an end pad if necessary. As in the case of the bottom pads 24, each top pad 26 is preferably provided with the hole 110 on one side or the other of the pad so that any pad in the line is convertible to an end pad. In such a circumstance, threaded rods (not shown), like pins 104, or an end plate 108 (FIG. 1) are secured to the top pads to provide stops for the end plates of the truss. A scribe center line 112 is provided in a central location perpendicular to the rails for aligning the angle plates 16 with respect to the top plates 12. A tapped alignment hole 113 is provided at the scribed line 112 for alignment of the top plates in a manner which has been described hereinabove with respect to tapped holes 102 in the bottom pads 24.

Tapped central holes 114 are provided with threaded nail plate positioning lugs 116 for retaining the nail plates. The lugs 116 have narrow blades which extend slightly above the surface of the top pad 26 so that they project slightly into the holes in the nail plates. The threaded bodies of the lugs 116 make them vertically adjustable for precise positioning with respect to the top surface of the pad 26.

Retaining stops and locks 118 and 120 are provided on top of the positioning pads 26. A pressure plate 122 is pivotally mounted on pin 128 for movement from the position illustrated in FIG. 5 to a position aligned with the scribe center line 112 as shown in FIG. 1. In the latter position, the pressure plate 122 is in engagement with the retaining stops and locks 118 and 120. A connecting link 124 is pivotably mounted to an end of the pressure plate 122 and is pivotably mounted at the other end thereof to the piston rod of pressure cylinder 28 through a clevis mounting 126. As the cylinder 28 is operated to extend the piston rod, the linkage 124 pulls the right end of the pressure plate 122 (as viewed in FIG. 5) downwardly to swing the other end thereof firmly against the top plate in the truss (not shown in FIG. 5). In this position, the other end of the pressure plate 122 rigidly abuts the retaining stop and lock 120 and braces the truss in a slightly stressed condition, as seen in FIG. 1.

Figure 6:
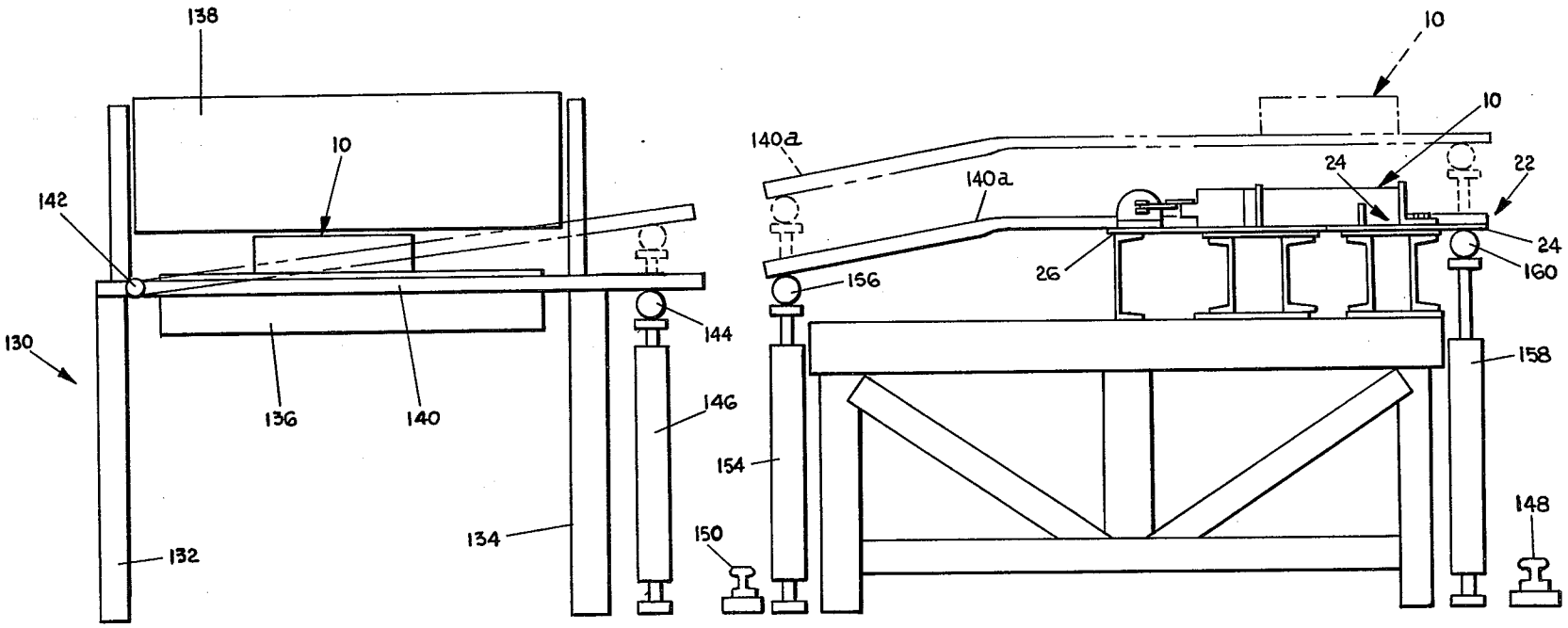
FIG. 6 is a side view similar to FIG. 3 illustrating the manner in which the completed truss is removed from the truss making machine.

Reference is now made to FIG. 6 for a description of the manner in which the partially completed trusses are removed from the truss making machine and transferred to a roller conveyor for completion of pressing of the nail plate into the truss. As illustrated in FIG. 6, the truss making apparatus 22 is positioned adjacent and parallel to a roller conveyor 130. Upright side supports 132 and 134 rotatably mount roller 136 and comprise the roller conveyor 130. A roller press 138, which can be a two high roller press (not shown), is provided at the end of the roller for completely pressing the nail plates into the truss apparatus. The roller press can be any conventional roller press, such as a Gantry press disclosed in U.S. Pat. No. 3,255,943, to Sanford or U.S. Pat. No. 3,464,348 to McGlinchey, or U.S. Pat. No. 3,538,843 to Lubin. Alternatively, a stationary two high roller press, such as that manufactured by Clary Corporation, Ft. Worth, Tex., or Sanford Industries, Pompano Beach, Fla., can be employed.

A plurality of transfer rods 140 are rotatably mounted at 142 at one side of the roller conveyor 130. The rods extend across the roller conveyor 130 but beneath the top surface of the roller 136 and rest on an elongated pipe 144 at the opposite side of the roller conveyor. Transfer rods **140*a* extend across the truss making apparatus 22 and rest on pipes 156 and 160. Fluid pressure cylinders 154 and 158 support the pipes 156 and 160, respectfully. The rods 140*a* in normal position illustrated in FIG. 6 are positioned beneath the top surfaces of the bottom pad 24 and top pad 26**.

The pipe 144 is supported on the end of extendible rods of a plurality of fluid pressure cylinders 146. When the cylinders 146, 154 and 158 are operated to extend the rods thereof, the pipes 144, 156 and 160 are raised, thereby raising the transfer rod 140 about pivot point 142, and thereby raising rod **140*a*. The raised positions of the transfer rods 140 and 140*a* are illustrated in phantom lines in FIG. 6. When the rods 140*a* are raised, the truss 10 is also raised from the pads 24 and 26. The truss can be pushed onto the rods 140 and will slide down the incline formed by the rods 140 onto the rollers 136. The transfer rods 140 and 140*a* are then lowered and the truss is propelled by means (not shown) which drive the rollers 136 through the roller press 138**.

A rail 148 is positioned at each side of the truss making apparatus 22 at the left side (as viewed in FIG. 6) of the roller conveyor 130 for transporting the roller press 152 over the truss 10 to initially press the nail plates into the truss.

Figure 7:
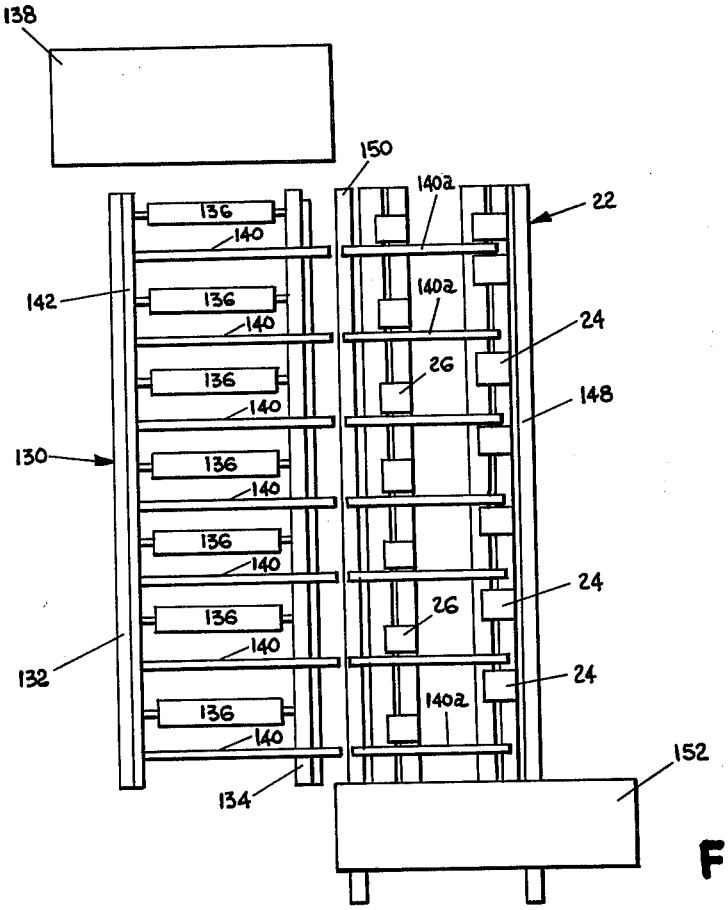
FIG. 7 is a schematic view showing the method of making the truss members according to the invention.

Reference is now made to FIG. 7 which schematically shows the apparatus according to the invention. As seen in FIG. 7, the press 152 rides on rails 148 and 150 which are positioned outside of the truss making apparatus 22. The press 152 can be any conventional movable Gantry press, such as disclosed, for example, in U.S. Pat. No. 3,538,843 to Lubin. The roller conveyor 130 is positioned adjacent to the truss making apparatus 22 and the roller press 138 is positioned at an end of the roller conveyor 130 opposite to the normal position of the roller press 152.

In operation, the top and bottom pads 26 and 24 are positioned in a desired location along their respective rails. The alignment of the pads can be accomplished with the use of a spacer bar at the tapped holes 120 in the bottom pads and 113 in the top pads as described above. Further, the spacing between the pad supporting rails is set as desired by rotating crank 78 for variance in height of the truss. The rails for the top and bottom pads have a slight camber or arc congruent with each other so that the resulting truss has a slight camber. Generally the radius of curvature of the rails is such that the deviation from linearity is in the range of 0.1–0.4%, preferably about 0.21%. In any given position, the rods 140 may interfere with the top and bottom pads 26 and 28. However, the rods 140 and 140*a* are slidably mounted at the pivot points 142 so that adjustment of the transfer rods 140 and 140*a* with respect to the top and bottom pads 26 and 24 can be easily accomplished. During the adjustment process for the top and bottom pads 26 and 24, the transfer rod 140*a* can be positioned in a raised position illustrated in phantom lines in FIG. 6 to facilitate alignment of the pads 24 and 26. After alignment, the rods are dropped to the position illustrated in FIG. 6. The distance between the positioning pads 24 and 26 can thereafter be adjusted by rotating crank handle 78 to rotate the threaded rods 76.

When the pads 24 and 26 have been tightened into adjusted position, nail plates are positioned on each of the pressure pads with the nail plates, for example, engaging the lugs 116 in the top pads 26 and engaging the lugs 94 in the bottom pads 24. The top plate 12, bottom plates 14, angle plates 16 and end plates 18 are then positioned in proper location on the pads 24 and 26. During this positioning process, the cylinders 28 are in retracted condition so that the pressure plate 122 will be in retracted position as illustrated in FIG. 5. After the various truss elements are positioned on the pads over the bottom nail plates, the cylinders 28 are then actuated to rotate the pressure plates 122 into locking position abutting the top plates 12 and pressing the top plate 12 against stop pins 104. Additional nail plates are then placed on top of the truss members at each joint thereof. Subsequent to placing of the top nail plates, the roller press 152 is rolled along tracks 148 and 150 over the assembled truss, thereby pressing the top nail plate and bottom nail plate at least partially into the truss members at the joints. Generally, the top nail plate will be completely pressed into the truss but the bottom nail plate will only be partially pressed into the truss plates. In this manner, the truss is locked together even though the nail plates may not be completely seated in the joints. The pads are held rigidly with respect to each other by the threaded rods 76 during the nailing operation. The cylinders are then deactuated to rotate the pressure plates 122 to a nonengaging position as illustrated in FIG. 5. The cylinders 146, 154 and 158 are actuated to raise the transfer rods 140 and 140*a* and the truss 10 to the position illustrated in phantom lines in FIG. 6. The truss then slides down the transfer rods onto the roller conveyor 130. The cylinders 146, 154 and 158 then retract their piston rods, thereby lowering pipe 144 and the transfer rods 140 and 140*a*. Subsequently the roller conveyor 130 is driven to drive the truss through the roller press 138 which is driven to completely seat the nail plates in the truss.

Whereas the invention has been described with respect to the making of floor trusses, the invention could also be used for making parallel chord roof trusses, i.e., trusses which have parallel top and bottom plates, as used for example in flat roof constructions.

Reasonable variation and modification are possible within the scope of the foregoing disclosure, the drawings and appended claims without departing from the spirit of the invention.

The embodiments of the invention in which an exclusive property or privilege is claimed are defined as follows:

1. An apparatus for making trusses having parallel first and second elongated truss plates, end truss plates at the ends of the first and second truss plates and angle truss plates disposed in bracing relationship between the first and second truss plates, the apparatus comprising in combination:

a supporting base;

a first rail mounted on the base;

a second rail mounted on the base;

means for evenly and simultaneously adjusting spacing between the first and second rails;

a plurality of first positioning pads adjustably secured to the first rail in spaced relationship to each other;

the end and another of the first positioning pads having means for retaining a first elongated truss plate parallel to the first rail;

a plurality of second positioning pads adjustably mounted on the second rail in spaced relationship to each other;

at least the end ones of the first and second positioning pads having stop means to retain an end truss member thereon perpendicular to the first and second rails;

the end and another of the second positioning pads having means for retaining a second elongated truss member parallel to the first and second rails;

means on the first and second positioning pads for retaining nail plates thereon in a given predetermined location;

means on the second positioning pads for applying pressure to the second elongated truss plate to firmly seat all of the truss plates together prior to seating of the nail plates;

the first and second pads being so spaced and aligned so as to support the opposite ends of angle truss plates extending between the first and second truss plates; and means for at least partially pressing the nail plates simultaneously into the top and bottom of truss plates positioned at the positioning pads.

2. An apparatus for making trusses according to claim 1 wherein the first and second rails have a slight congruent curvature in the plane of the truss so that the resulting truss has a slight upward curvature, whereby the trusses are prestressed.

3. An apparatus for making trusses according to claim 2 wherein the radius of curvature of each of the rails is such that the deviation from linearity is in the range of 0.1–0.4%.

4. An apparatus for making trusses according to claim 2 wherein the first and second rail adjusting means comprise a plurality of threaded members journaled in one of the first and second rails and threadably engaging the other of the first and second rails at spaced intervals therealong; means for connecting said threaded members so that the connected threaded members move in unison to evenly move the one rail segment, whereby said rails are held rigidly with respect to each other by said threaded rods.

5. An apparatus for making trusses according to claim 1 wherein the first positioning pad has means for adjustably positioning the retaining means for the first elongated truss plate with respect to the second positioning pads to accommodate different size truss plates.

6. An apparatus for making trusses according to claim 1 wherein at least one of the first and second positioning pads has means for aligning the angle truss plate ends at a given position on the respective pads.

7. An apparatus for making trusses according to claim 1 wherein the nail plate retaining means on at least one of the first and second pads comprises a plurality of pins having a top which is shaped to fit within the holes in the nail plate and means mounting the pins for adjustment of height with respect to the positioning pad.

8. An apparatus for making trusses according to claim 1 wherein the retaining means for the second elongated truss members on the second pads comprise means for retaining the second truss plates in a given position against the force of the pressure applying means.

9. An apparatus for making trusses according to claim 1 wherein the pressure applying means comprise a plate pivotably mounted on each of the second positioning pads for movement between a first position in nonengaging relationship to the second truss member and a second position in bracing position with respect to the second truss plate, and means for actuating the movement of the plate between the first and second positions.

10. An apparatus for making trusses according to claim 9 and further comprising lock means on the second positioning pads for locking the plate rigidly in the second position.

11. An apparatus for making trusses according to claim 9 wherein the retaining means for the second truss plates are adjustable to accommodate different size plates.

12. An apparatus for making trusses according to claim 1 and further comprising means for completely seating the nail plates in the truss, and means for conveying the assembled trusses to the nail plate seating means.

13. An apparatus for making trusses according to claim 1 wherein the first and second rail adjusting means comprise a plurality of threaded members journaled in one of the first and second rails and threadably engaging the other of the first and second rails at spaced intervals therealong; means for connecting said threaded members so that the connected threaded members move in unison to evenly move the one rail segment, whereby said rails are held rigidly with respect to each other by said threaded rods.

14. An apparatus for making trusses according to claim 1 wherein the center lines of said first positioning pads are equally spaced from each other and the center lines of said second positioning pads are equally spaced from each other, and means for establishing the equal spacing between the first and second positioning pads.

* * * * *